United States Patent [19]

Renaud

[11] Patent Number: 4,868,989

[45] Date of Patent: Sep. 26, 1989

[54] WALLPAPER BORDER CUTTER DEVICE

[76] Inventor: Fredric T. Renaud, 86 Larkspur Ct., Bedminster, N.J. 07921

[21] Appl. No.: 263,181

[22] Filed: Oct. 27, 1988

[51] Int. Cl.[4] ..... B26B 29/00

[52] U.S. Cl. ..... 30/293; 30/294

[58] Field of Search ..... 30/286, 289, 290, 292–294

[56] References Cited

U.S. PATENT DOCUMENTS 4,443,942 4/1984 Demeter ..... 30/293

4,549,351 10/1985 Stanbery et al. ..... 30/293

*Primary Examiner*—Douglas D. Watts

*Attorney, Agent, or Firm*—Kenneth P. Glynn

[57] ABSTRACT

The present invention is directed to a wallpaper border cutter device which is used for trimming wallpaper at a preselected level below a ceiling. The device includes a base which has a substantially flat face surface and is of adequate thickness to support wheels. Additionally, it has a protruding member extending outwardly from the face surface for receiving a slidable blade holder. There is a first plurality of wheels mounted on the base in a plane at about 90° to the face surface of the base for rolling the cutter device along a wall as well as a second plurality of wheels mounted on the base for rolling the cutting device along the ceiling and in combination with the first plurality of wheels for rolling the cutting device simultaneously along a wall and a ceiling. The device also includes a plurality of parallel blade holder mounting slots which are located on the protruding member for slidably mounting a blade holder as well as at least one cutting slot and in a preferred embodiment two cutting slots located on the base for permitting a portion of the blade to extend therethrough. A blade holder is removably and slidably mounted in the plurality of parallel blade holder mounting slots and a locking mechanism is connected to the blade holder and at least one of the parallel blade holder mounting slots so as to permit temporary locking of the blade holder at a preselected location along the plurality of parallel blade holder mounting slots. A blade receiver and clamping mechanism is attached to the blade holder and located to receive a glade in a clamped position so that a cutting edge would extend into a cutting slot located on the base.

22 Claims, 3 Drawing Sheets

WALLPAPER BORDER CUTTER DEVICE

BACKGROUND OF THE INVENTION

1. Field of the Invention

The present invention is directed to wallpaper border cutters and more particularly to such devices which enable the user to make even, smooth cuts in wallpaper for subsequent hanging of a wallpaper border. Thus, the present invention cutter device is a tool for simplifying and increasing the efficiency of hanging wallpaper which includes separately hangable borders.

2. Prior Art Statements

Mechanical cutters have been known for many decades and have been designed to facilitate the speed with which users cut various materials as well as to aid in determining particular width, depths or other dimensions of cuttings. Thus, in general, the prior art describes implements for cutting linoleum, cardboard, paperboard, wood and the like and the prior art is exemplified by U.S. Pat. Nos. 2,007,395 to George 0. Howard; 2,601,183 to Phillip H. Unsinger; 2,641,834 to Stanley F. Bobrowski et al.; 2,880,506 to Charles H. Zimmerman. Each of these patents show various types of cutting implements which basically are designed to slide along an edge of a board or linoleum or the like and have a blade holder. In most cases, the devices also include means for adjusting the cutting widths. Regarding the art of specifically cutting wallpaper and devices for paperhanging in general, the art is typified by U.S. Pat. Nos. 2,004,426 issued to Arthur Gelleff; 4,077,124 issued to Norbert Christmann; and 4,501,069 issued to Seiji Kohno. These patents show various types of devices for holding a blade in place with sliders or alignment possibilities designed to allow the operator to cut straight lines of desired widths.

Notwithstanding the prior art, no prior art patent teaches or renders obvious the device of the present invention which calls for a unique cutting device which travels simultaneously along a wall and a ceiling on free spinning wheels and yet has an adjustable blade which may be present at a selected distance from the ceiling and which holds a cutting blade in place for smooth parallel cutting so as to enable the use to rapidly glide across hung wallpaper to cut and remove the top portion to create an even edge for abutment with a separately hung wallpaper border which will meet flush with the wallpaper in the same plane. Further, in a preferred embodiment of the present invention, a blade holder is slidably removable and may be reversed so the device may be moved along a wall from left to right or from right to left, either to allow left handed or right handed person to use it comfortably or to permit reversable directions in ackward locations.

BRIEF SUMMARY OF THE INVENTION

The present invention is directed to a wallpaper border cutter device which is used for trimming wallpaper at a preselected level below a ceiling. The device includes a base which has a substantially flat face surface and is of adequate thickness to support wheels. Additionally, it has a protruding member extending outwardly from the face surface for receiving a slidable blade holder. There is a first plurality of wheels mounted on the base in a plane at about 90° to the face surface of the base for rolling the cutter device along a wall as well as a second plurality of wheels mounted on the base in a plane parallel to the face surface of the base for rolling the cutting device along a ceiling and in combination with the first plurality of wheel for rolling the cutting device simultaneously along a wall and a ceiling. The device also includes a plurality of parallel blade holder mounting slot which are located on the protruding member for slidably mounting a blade holder as well as at least one cutting slot and in a preferred embodiment two cutting slots located on the base for permitting a portion of the blade to extend therethrough. A blade holder is removably and slidably mounted in the plurality of parallel blade holder mounting slots and a locking mechanism is connected to the blade holder and at least one of the parallel blade holder mounting slots so as to permit temporary locking of the blade holder at a preselected location along the plurality of parallel blade holder mounting slots. A blade receiver and clamping mechanism is attached to the blade holder and located to receive a blade in a clamped position so that a cutting edge would extend into a cutting slot located on the base.

BRIEF DESCRIPTIONS OF THE DRAWINGS

The invention will be more fully understood by referring to the following detailed specification, the above specification, and the claims set forth herein, when taken in connection with the drawings attached hereto, wherein:

DETAILED DESCRIPTION OF THE PRESENT INVENTION

The present invention is directed to efficient, accurate cutting of prehung wallpaper for removal of irregular top edges and for creation of space against portion of the wall paper for the subsequent hanging of a separate wallpaper border strip. The present invention is directed to the simultaneous movement of the device along both a wall and a ceiling while providing for a cutting blade which is slidably adjustable and removable and which, in its preferred embodiments, may be reversed for either left hand use or right hand use.

Figure 1:
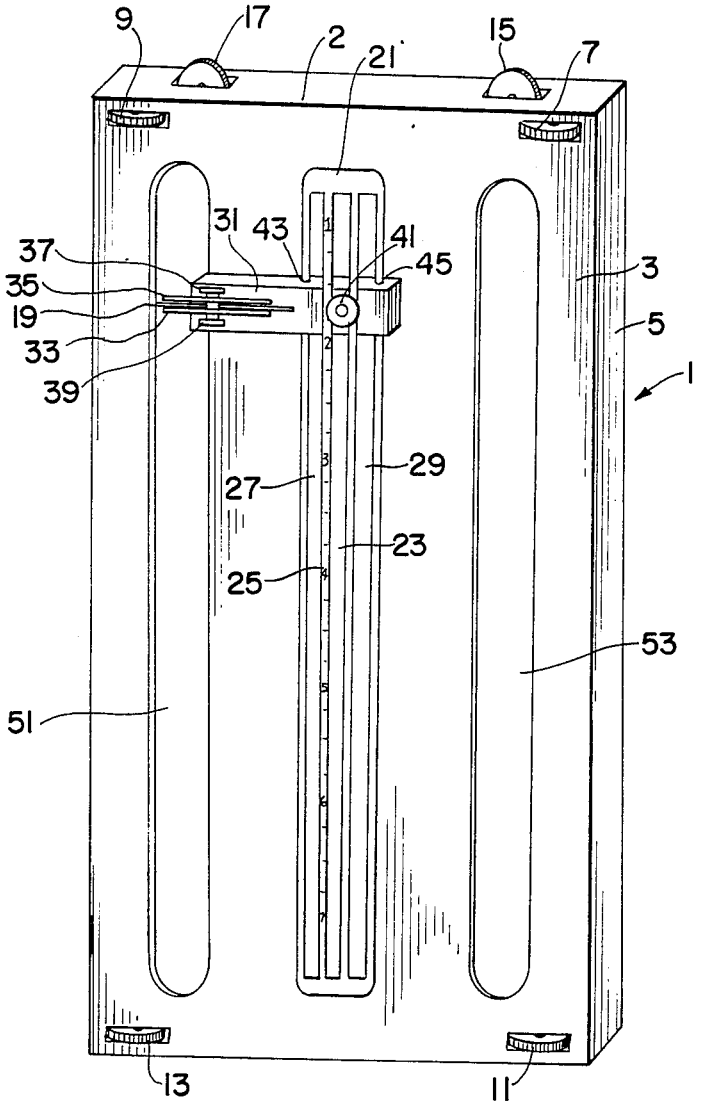
FIG. 1 illustrates a top view or a face surface view of the present invention cutter device.

Referring now to FIG. 1, there is shown wallpaper cutter device 1 for trimming wallpaper at a selected level below a ceiling and this. includes a base 2 having a substantially flat face surface 3 which is of adequate thickness to support wheels as shown. Base 2 also has a protruding member 21 which extends outwardly from said face surface 3 for receiving a slidable blade holder 31. A first plurality of wheels, in this case wheels 7, 9, 11 and 13, are mounted on said base in planes at about 90° to the face surface 3, as shown, for rolling the cutter device along a wall. A second plurality of wheels 15 and 17 are mounted on the base 2 in a plane parallel t face surface 3 for rolling the cutter device 1 along a ceiling. Thus, first plurality of wheels 7, 9, 11 and 13 and second plurality of wheels 15 and 17, when working together, enable one to simultaneously move the device in a gliding, smooth fashion along both a wall and a ceiling parallel to the wall surface and to the ceiling surface. A plurality of blade holder mounting slots, in this case side slots 27 and 29 and top slot 23, are located on protruding member 21 for slidably mounting blade holder 31, as shown. At least one cutting slot is located on base 2 and in this case two cutting slots, slot 51 and slot 53, are located in parallel and on opposite sides of protruding member 21, these being located on face surface 3 of base 2, as shown. These cutting slots 51 and 53 allow for a blade such as blade 19 to extend below face surface 3 and in fact below the entire base 2 s as to enable one to cut wallpaper therewith.

Figure 2:
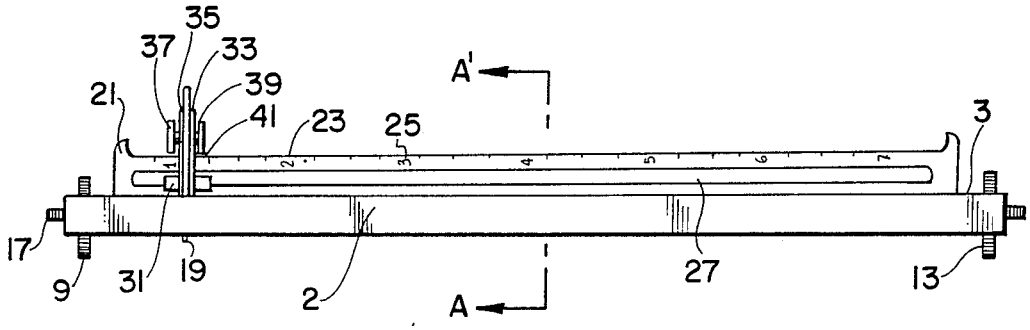
FIG. 2 shows a side view of the device of the present invention and FIG. 3 shows a cut view of the device shown in FIG. 2 along cut line A of FIG. 2; and, FIGS. 4 and 5 show an alternative embodiment with double cut capabilities and with slider protrusion tips.
Figure 3:
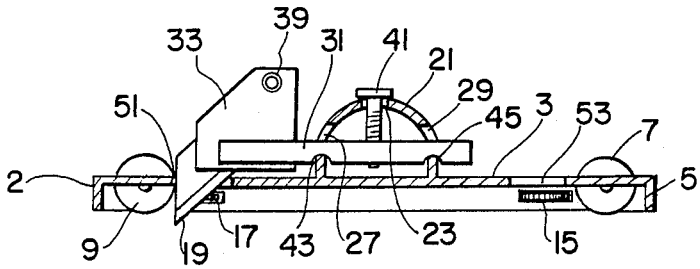

Referring now, simultaneously to FIGS. 1, 2 and 3, note that blade holder 31 includes a locking mechanism consisting of parallel plates 33 and 35 which are squeezed by screw 37 and screw receiver 39 by rotation of screw 37. Thus, blade 19 may be received and clamped in a fixed fashion until the blade needs to be replaced by tightening screw 37 as shown. Also, as illustrated most precisely by FIGS. 2 and 3, blade 19 has a cutting edge which extends below the wheels 7, 9, 11 and 13 and below base 2. Also, note that blade holder 31 has notches or grooves 43 and 45 which aid in stabilizing its position when located within parallel mounting slots 27 and 29. Screw 41 is used to tighten blade holder 31 in a fixed position and graduations and numbers typified by numeral 25 shown in FIGS. 1 and 2 enable the user to more accurately preselect a blade location which would identify exactly the distance from a ceiling to the blade when cutter device 1 is positioned up against a wall and a ceiling whereby wheels 15 and 17 touch a ceiling and wheels 7, 9, 11 and 13 touch a connecting wall.

Figure 4:
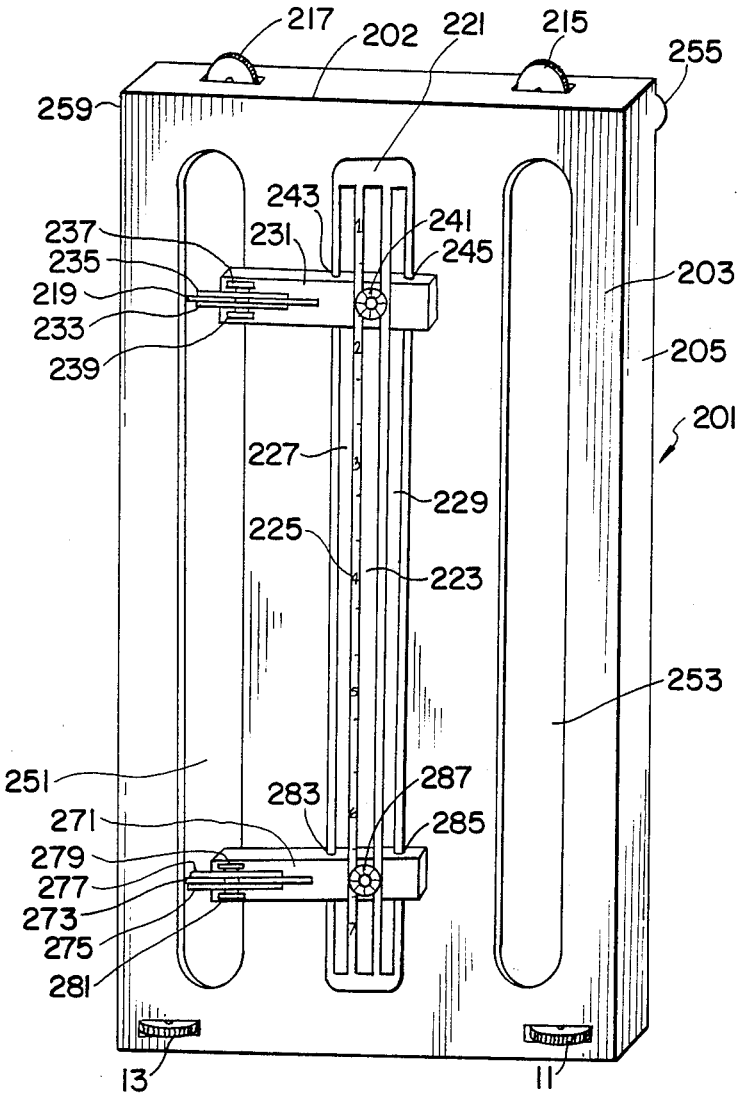
Figure 5:
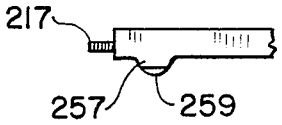

Referring to FIGS. 4 and 5, and particularly to FIG. 4, there is shown an alternate preferred wallpaper cutter device 201 for trimming wallpaper at a selected level below a ceiling and this includes a base 202 having a substantially flat face surface 203 which is of adequate thickness to support wheels as shown. Base 202 also has a protruding member 221 which extends outwardly from said face surface 203 for receiving a slidable blade holder 231. A first plurality of wheels, in this case wheels 211 and 213, are mounted on said base in planes at about 90° to the face surface 3, as shown, along the lower part of device 201. There are also a plurality of slider protrusions 255 and and 257 (FIG. 5). As shown in FIG. 5, which is a side cut view of the upper left corner 259 of device 201, protrusion 257 has a Teflon tip 261 inserted therein. Slider protrusion tips typified by 261, along with wheels 211 and 213 act in harmony to permit smooth rolling of the cutter device along a wall. A second plurality of wheels 15 and 17 are mounted on the base 202 in a plane parallel to face surface 3 for rolling the cutter device 20 along a ceiling. Thus, first plurality of wheels 211 and 213, glider protrusion tips, and second plurality of wheels 15 and 17, when working together, enable one to simultaneously move the device in a gliding, smooth fashion along both a wall and a ceiling parallel to the wall surface and to the ceiling surface. A plurality of blade holder mounting slots in this case side slots 227 and 229 and top slot 223, are located on protruding member 221 for slidably mounting two blade holders 231 and 271, as shown. At least one cutting slot is located on base 202 and in this case two cutting slots, slot 251 and slot 253, are located in parallel and on opposite sides of protruding member 221, these being located on face surface 203 of base 202, as shown. These cutting slots 251 and 253 allow for two blades such a blade 219 and blade 273 to extend below face surface 203 and in fact below the entire base 202, so as to enable one to cut simultaneous cuts for a center, top, or wainscoting border.

Not that blade holders 231 and 271 each include a locking mechanism consisting of parallel plates 233 and 235 and 275 and 277 respectively, which are squeezed by screws 237 and 279 and screw receivers 239 and 281 by rotation of screws 237 and 279 respectively clamped in fixed fashion until the blade needs to be replaced by tightening screw 31 as shown. Also, note that blade holders 231 and 271 have notches or grooves 243, 245, 283 and 285 which aid in stabilizing their positions when located within parallel mounting slots 227 and 229, as shown. Screws 241 and 287 are used to tighten blade holders 231 and 271 in fixed positions and graduations and numbers typified by numeral 225 enable the user to more accurately preselect the blade locations for the simultaneous double cut of the wallpaper.

The particular blade holder, as well as the blade receiver and clamping mechanism, is a matter of choice by the artisan and alternative techniques may be employed which are known and which are shown in the prior art cited above, without exceeding the scope of the invention. Likewise, the particular shape of the protrusion 21 of the device is a matter of design and may be rectilinear, cylindrical, or may even include some irregular shapes such as indentures for grasping. In this regard, it should be noted that the protruding member 21 is of significant proportions and should be of significant strength for a user to us that protruding member 21 as a handle in addition to a mounting mechanism for the blade holder. Also the particular types of dimensions and the exact length or width of the device is of no significance. Further, the type of wheels chosen may be the disc type wheels shown, or may be mounted roller type wheels, as long as they are free rotating. Additionally, the glider protrusion tips which are used in place of some of the wall contact wheels may be unistructurally molded into the device or may be partially molded into the device with inserted tips such as plastic, rubber, teflon or other material, or may be roller or ball bearing type attachments, collectively herein referred to as slider protrusion tips.

The particular choice of material for producing the present invention device is a matter of choice. However, the device may readily be fabricated out of pressed metal o heavy duty molded plastic and the wheels may be plastic, metal, or non-marking rubberized material. The blade holder may be designed to receive flag single edged trapezoidal type professional cutting blades or to receive conventional shaving blades, either double edged or single edged and may or may not be designed to receive both of these types of blades, without exceeding the scope of the present invention.

What is claimed is:

1. A wallpaper border cutter device for trimming wallpaper at a preselected level below a ceiling, which comprises;

(a) a base having substantially flat face surface and being of adequate thickness to support wheels, and having a protruding member extending outwardly from said face surface for receiving a slidable blade holder;

(b) a first plurality of wheels mounted on said base in planes at about 90° to said face surface of said base for rolling the cutter device along a wall;

(c) a second plurality of wheels mounted on said base in a plane parallel to said face surface of said base for rolling the cutter device along a ceiling, and, in combination with said first plurality of wheels for rolling said cutter device simultaneously along a wall and a ceiling;

(d) plurality of parallel blade holder mounting slots located on said protruding member for slidably mounting a blade holder;

(e) at least one cutting slot located on said base for permitting a portion of a blade to extend therethrough;

(f) a blade holder removably and slidably mounted in said plurality of parallel blade holder mounting slots;

(g) a locking mechanism connected to said blade holder and at least one of said parallel blade holder mounting slots so as to permit temporary locking of said blade holder at a preselected location along said plurality of parallel blade holder mounting slots; and (h) a blade receiver and clamping mechanism attached to said blade holder and located such that a blade clamped therein could have a cutting edge extend into a cutting slot located on said base.

2. The cutter device of claim 1 wherein said base has two cutting slots located thereon said cutting slots being parallel to one another and being on opposite sides of said protruding member so as to render the blade holder reversable for right handed or left handed use.

3. The cutter device of claim 1 wherein graduated marks are set forth thereon for more accurate preselection of a blade location.

4. The cutter device of claim 3 wherein said graduated marks include distance measurements which indicate distance from a ceiling when said first plurality of wheels is located against a wall and said second plurality of wheels is located against a ceiling.

5. The cutter device of claim 2 wherein graduate marks are set forth thereon for more accurate preselection of a blade location.

6. The cutter device of claim 5 wherein said graduated marks include distance measurement which indicate distance from a ceiling when said plurality of wheels is located against a wall and said second plurality of wheels is located against ceiling.

7. The cutter device of claim 1 wherein said blade receiver and clamping mechanism is a screw and parallel plate mechanism which may be opened and closed by screw rotation to receive and clamp a blade.

8. The cutter device of claim 2 wherein said blade receiver and clamping mechanism is a screw and parallel plate mechanisms which may be opened and closed by screw rotation to receive and clamp a blade.

9. The cutter device of claim 3 wherein said blade receiver and clamping mechanism is a screw and parallel plate mechanisms which may be opened and closed by screw rotation to receive and clamp a blade.

10. The cutter device of claim 4 wherein said blade receiver and clamping mechanism is a screw and parallel plate mechanism which may be opened and closed by screw rotation to receive and clamp a blade.

11. A wallpaper border cutter device for trimming wallpaper at a preselected level, which comprises;

(a) a base having substantially flat face surface and being of adequate thickness to support wheels, and having a protruding member extending outwardly from said face surface for receiving a slideable blade holder;

(b) a first plurality of wheels mounted on said base in planes at about 90° to said face surface of said base for rolling the cutter device along a wall;

(c) a second plurality of wheels and a plurality of slider protrusion tips, mounted on said base in a plane parallel to said face surface of said base for rolling the cutter device along a ceiling, and, in combination with said first plurality of wheels for rolling said cutter device simultaneously along a wall and a ceiling;

(d) a plurality of parallel blade holder mounting slots located on said protruding member for slidably mounting a blade holder;

(e) at least one cutting slot located on said base for permitting a portion of a blade to extend therethrough;

(f) a blade holder removably and slidably mounted in said plurality of parallel blade holder mounting slots;

(g) a locking mechanism connected to said blade holder and at least one of said parallel blade holder mounting slots so as to permit temporary locking of said blade holder at a preselected location along said plurality of parallel blade holder mounting slots; and (h) a blade receiver and clamping mechanism attached to said blade holder and located such that a blade clamped therein could have a cutting edge extend into a cutting slot located on said base.

12. The cutter device of claim 11 wherein said base has two cutting slots located thereon, said cutting slots being parallel to one another and being on opposite sides of said protruding member so as to render the blade holder reversable for right handed or left handed use.

13. The cutter device of claim 11 wherein graduated marks are set forth thereon for more accurate preselection of a blade location.

14. The cutter device of claim 13 wherein said graduated mark include distance measurements which indicate distance from a ceiling when said first plurality of wheels is located against a wall and said second plurality of wheels is located against a ceiling.

15. The cutter device of claim 12 wherein graduated marks are set forth thereon for more accurate preselection of a blade location.

16. The cutter device of claim 15 wherein said graduated marks include distance measurements which indicate distance from a ceiling when said plurality of wheels is located against a wall and said second plurality of wheels is located against a ceiling.

17. The cutter device of claim 11 wherein said blade receiver and clamping mechanism is a screw and parallel plate mechanism which may be opened and closed by screw rotation to receive and clamp a blade.

18. The cutter device of claim 12 wherein said blade receiver and clamping mechanism is a screw and parallel plate mechanisms which may be opened and closed by screw rotation to receive and clamp a blade.

19. The cutter device of claim 13 wherein said blade receiver and clamping mechanism is a screw and parallel plate mechanisms which may be opened and closed by screw rotation to receive and clamp a blade.

20. The cutter device of claim 14 wherein said blade receiver and clamping mechanism is a screw and parallel plate mechanism which may be opened and closed by screw rotation to receive and clamp a blade.

21. The cutter device of claim 1 which further includes a second blade holder, locking mechanism and blade receiver and clamping mechanism for simultaneous double cutting.

22. The cutter device of claim 11 which further includes a second blade holder, locking mechanism and blade receive and clamping mechanism for simultaneous double cutting.

* * * * *